US011746493B2

(12) United States Patent
Wen

(10) Patent No.: US 11,746,493 B2
(45) Date of Patent: Sep. 5, 2023

(54) WALL SINKING CONSTRUCTION METHOD

(71) Applicant: Yanxu Wen, Nanjing (CN)

(72) Inventor: Yanxu Wen, Nanjing (CN)

(73) Assignee: Yanxu Wen, Nanjing (CN)

( * ) Notice: Subject to any disclaimer, the term of this patent is extended or adjusted under 35 U.S.C. 154(b) by 128 days.

(21) Appl. No.: 17/598,584

(22) PCT Filed: Apr. 16, 2019

(86) PCT No.: PCT/CN2019/000067
§ 371 (c)(1),
(2) Date: Sep. 27, 2021

(87) PCT Pub. No.: WO2020/198897
PCT Pub. Date: Oct. 8, 2020

(65) Prior Publication Data

US 2022/0195687 A1 Jun. 23, 2022

(30) Foreign Application Priority Data

Apr. 4, 2019 (CN) ..... 201910274122.2

(51) Int. Cl.

| | |
|---|---|
| ***E02D 29/045*** | (2006.01) |
| ***E02D 29/09*** | (2006.01) |
| ***E02D 17/04*** | (2006.01) |
| ***E02D 29/02*** | (2006.01) |

(52) U.S. Cl.
CPC ..... *E02D 29/06* (2013.01); *E02D 17/04* (2013.01); *E02D 29/02* (2013.01); *E02D 29/045* (2013.01); *E02D 2250/0061* (2013.01)

(58) Field of Classification Search
CPC ..... E02D 29/06; E02D 17/04; E02D 29/02; E02D 29/045; E02D 2250/0061; E02D 23/08; E02D 23/14; E02D 35/005; E02D 7/00
See application file for complete search history.

(56) References Cited

U.S. PATENT DOCUMENTS 3,779,322 A * 12/1973 Stevens ..... E21B 10/02 405/133
4,797,031 A * 1/1989 Hagimoto ..... E02D 23/08 405/133

(Continued)

FOREIGN PATENT DOCUMENTS

CN 202144598 * 2/2012

*Primary Examiner* — Carib A Oquendo
(74) *Attorney, Agent, or Firm* — CBM PATENT CONSULTING, LLC

(57) ABSTRACT

A wall sinking construction method comprises retaining structures are first formed on two sides, corresponding to a groove body, of the wall body; then a section of wall body of a certain height is produced on the ground, and jacks and a supporting pile body are installed on the two sides of the bottom of the wall body that is supported by the jacks and the supporting pile body, the bottom of the wall body is suspended to form an excavation working space with a certain height; an underwater excavator is controlled remotely to excavate rock and soil in the groove body layer by layer; an elastic support having rollers is sandwiched between the retaining structures on the two sides of the wall body and the groove body to transfer and balance rock and soil pressure.

10 Claims, 3 Drawing Sheets

(56) References Cited

U.S. PATENT DOCUMENTS

| | | | | |
|---|---|---|---|---|
| 7,921,573 | B1 * | 4/2011 | Mancini | E02D 23/08 33/302 |
| 10,081,925 | B2 * | 9/2018 | Amirian | E02D 7/24 |
| 10,988,907 | B1 * | 4/2021 | Lan | E02D 7/00 |
| 11,078,788 | B1 * | 8/2021 | Lan | E21D 7/02 |
| 2012/0163919 | A1 * | 6/2012 | Irmscher | E04H 6/12 405/133 |

* cited by examiner

WALL SINKING CONSTRUCTION METHOD

CROSS REFERENCES

This application is the U.S. continuation application of International Application No. PCT/CN2019/000067 Filed on 16 Apr. 2019 which designated the U.S. and claims priority to Chinese Application No. CN201910274122.2 filed on 4 Apr. 2019, the entire contents of each of which are hereby incorporated by reference.

TECHNICAL FIELD

The present invention relates to the technical field of civil construction underground engineering, and in particular to a construction method for an underground wall.

BACKGROUND

A wall is first built on the ground, and the rock-soil mass of a trench corresponding to the wall is then excavated such that the wall sinks from the ground to the underground, which can be referred to as a wall-sinking method, while in the conventional open caisson method, the rock-soil mass enclosed in the caisson is completely excavated. There have been several patents providing methods and equipment for wall sinking. Chinese patent CN1120104A discloses a construction method for an underground wall, in which the cutting edge of the wall is crashed by water jetting to form mud water, which is pumped away by a jet pump, and the wall sinks itself due to the excavation of the cutting edge soil mass; resistance reduction and prevention of the soil wall collapse are achieved by means of water rings around membranes and the wall. Chinese patent CN101338567B discloses a construction method for an underground building using a rotary jetting open caisson method combined with a semi-reverse method, in which the outer walls of the underground structure are constructed using an integral rotary jetting sinking method. Chinese patent CN105926635B discloses vertical square prefabricated component construction equipment, an assembly and a construction method, in which two groups of rotatable and retractable stirring heads are provided and passed from the ground through an empty cavity of a wall to the bottom of the wall so as to stir the rock-soil mass at the bottom of the wall into slurry and thus to enable the wall to sink. In Chinese patent CN106759463A, a track provided with a chain cutter for excavating rock and soil is arranged at the bottom of a wall, and the chain cutter is activated to excavate the rock and soil at the bottom of the wall and bring them to the ground during construction such that the wall sinks.

The difficulty of the wall sinking lies in enabling the wall to sink in a controlled manner, namely, to sink to a specified position with a manageable effect on the nearby rock-soil mass. The above techniques still have insufficient capability to control wall sinking.

SUMMARY

The present invention aims to solve the technical problem that a wall is required to be controlled to sink so as to meet the requirements of the design for an acceptable effect on the position and the nearby area of the wall.

In the present invention, an operation space required by an excavator is provided by retaining structures formed on two sides before trench excavation and wall supports (including counterforce pieces, jacks, pillars and reinforced rock-soil masses under the pillars), such that the trench is excavated in an orderly manner, the adaptability to the stratum is good and the controlled wall sinking is basically ensured; elastic supports (with rollers) sandwiched between the retaining structures and the wall and jacks at the bottom of the wall are employed to control the wall sinking, with the elevation of the walls being controllable; elastic supports (with rollers and jacks) sandwiched between the retaining structures and the wall are employed so as to achieve controllable plane coordinates of the wall; with the orderly trench excavation, the retaining structures on the two sides of the trench and the elastic supports, the wall-sinking construction can be implemented under water so as to achieve a manageable effect of the wall sinking on the nearby area.

The construction method disclosed herein comprises the following steps:

1. Preparation before trench excavation:
   1) The physical and mechanical characteristics of the rock-soil mass in the trench corresponding to the wall are investigated so as to provide a basis for the selection of an excavator at the bottom of the wall, a basis for the length, end size and interval arrangement of pillars at the bottom of the wall, a basis for the selection and design of a local reinforcement measure for the rock-soil mass under the pillars at the bottom of the wall, and a basis for the travel determination of the jacks.
   2) The physical and mechanical characteristics of the rock-soil mass on the two sides of the trench corresponding to the wall are investigated so as to provide parameters for the design of the support with rollers between the retaining structures and the wall.
   3) The retaining structures are formed on the two sides (including soil outlets) of the trench corresponding to the wall; the rock-soil mass under the pillars at the bottom of the wall is locally reinforced; the trench is excavated to form a guide wall.
   4) A bottom plate of the wall and the wall of a certain height are fabricated on the ground. Cantilever counterforce pieces are symmetrically mounted or in situ cast at intervals on the wall near the bottom of the wall, and are also symmetrically mounted or in situ cast at tops of the pillars. The weight of the wall is transmitted from the counterforce pieces through the jacks to the pillars and then to the rock-soil mass not excavated in the trench, and thus, under the enclosure of the retaining structures on the two sides and the pillars, an operation space of a certain height is formed between the bottom of the wall and the rock-soil mass not excavated.
2. Controlled wall sinking construction:
   1) An underwater remote-controlled excavator is mounted in the operation space, and the rock-soil mass in the trench is excavated in layers along the direction of the wall, conveyed to a soil outlet and discharged by a grab bucket. When the excavation proceeds to a certain pillar, the pillar can be temporarily lifted by a jack, and then put down after a layer of the rock and soil under the pillar is excavated. When the pillar is lifted, the weight of the wall borne by the pillar is transmitted through the wall to adjacent pillars.
   2) In order to prevent the retaining structures on the two sides from being damaged, the single-layer excavation thickness is to be controlled. Elevation transmission can be achieved using a measuring rod (with controllable verticality) arranged from the ground deep to an excavation surface at the bottom of the wall so as to control the excavation elevation.

3) As the rock-soil mass is excavated in layers, each pillar is pressed by the jack until it is stably settled.

4) By the coordination of all jacks, the wall is controlled to uniformly sink in sections.

5) Between the wall and the retaining structures on the two sides of the trench are sandwiched elastic supports with rollers, which transmit and balance the rock-soil pressure and also ensure that the friction of the wall is controllable during sinking.

6) The wall needs to be built to a certain height on the ground when controlled by the jacks to sink to a certain depth. If necessary, the wall can be waterproofed on the ground.

3. Wall foundation construction:

1) After the wall sinks in place, the elevation of the wall is adjusted using jacks, and the plane position of the wall is adjusted using supports sandwiched between the wall and the retaining structures. The waste soil is cleaned, and the excavator is dismantled and recovered (this can be implemented using a manned submersible with manipulators or an underwater robot in the presence of water). The wall is backfilled at the bottom so as to complete the foundation construction.

2) The jacks and the measurement and control devices at the bottom of the wall are dismantled and recovered (this can be implemented using an underwater robot with manipulators in the presence of water).

4. Support replacement construction:

1) The shapes and curves of the trench wall and the wall at each support replacement position are measured, and gaskets are attached to prefabricated support sheet piles according to the curves;

2) After being separated into the trench, two prefabricated support sheet piles are separately attached to the trench wall and the wall and then connected by steel sheets to form a lattice support (this can be implemented by welding in the absence of water; or implemented using bolts in the presence of water, wherein the positions of the bolt holes on the steel sheets are obtained according to the actually measured distances of the corresponding points of the trench wall and the wall, as well as the thickness of the gaskets, the compression modulus and the positions of the pre-embedded bolt holes in the sheet piles).

3) After all supports are replaced, elastic support rods with rollers are lifted out.

5. Foundation trench backfilling:

The steps 3-5 may be implemented according to the actual engineering demands, for example, support replacement may be canceled if there is no need to recover the elastic support rods with rollers.

When used for foundation pit support, the construction method has the following characteristics:

1) The large-area excavation of the foundation pit can be implemented after the basement outer wall (permanent structure) and the steel support (detachable temporary structure) are connected on the ground and meanwhile controlled to sink in place, so that foundation pit safety emergencies caused by improper support can be prevented, thereby forming a safe and economical foundation pit support system, when the surroundings impose strict requirements on deformation, a corresponding retaining structure can be supported and pushed by the elastic support rod (comprising a jack) on the outside of the basement outer wall, and the loading is transmitted from the basement outer wall to a steel support wall, leading to a stable and reliable stress system such that the deformation is actively controlled.

2) The fabrication of the basement outer wall and waterproofing are both implemented on the ground. The construction is facilitated and the quality is ensured due to the sufficient operation space.

3) The steel support wall can be flexibly positioned, and the support system is highly adaptable to the construction scheme and geology, if cut-through unfavorable structure planes exist in the slope rock mass of the foundation pit, structure planes with small thickness are hard to recognize by conventional core-drilling inspection, causing problems for the design and construction. In this regard, the position of the structure plane can be determined according to the increased pressure of the jacks and the displacement of the spring in the elastic support rod contacting the outer retaining structure, which facilitates the control of effects produced by the unfavorable structure planes; the pressure of the outer unstable rock-soil mass can be transmitted through the elastic support rod (comprising a jack) to the inner rock-soil mass, such that the effects produced by the cut-through unfavorable structure planes are economically and properly controlled in time.

When used for slope retaining walls, the construction method has the following characteristics:

1) Compared to row piles, the wall has good integrity and bidirectional stress can be formed.

2) Compared to row piles, the wall can be backfilled behind with sand and stone, which facilitates the reduction in water pressure.

3) Compared to the conventional method in which retaining walls are constructed after the excavation at the bottom of a slope, the method in which the slope excavation is implemented after the retaining wall construction facilitates safe construction.

When used for cutoff walls, the construction method has the following characteristic:

1) The wall has better integrity than diaphragm walls, and has good anti-permeation capability.

Figure 1:
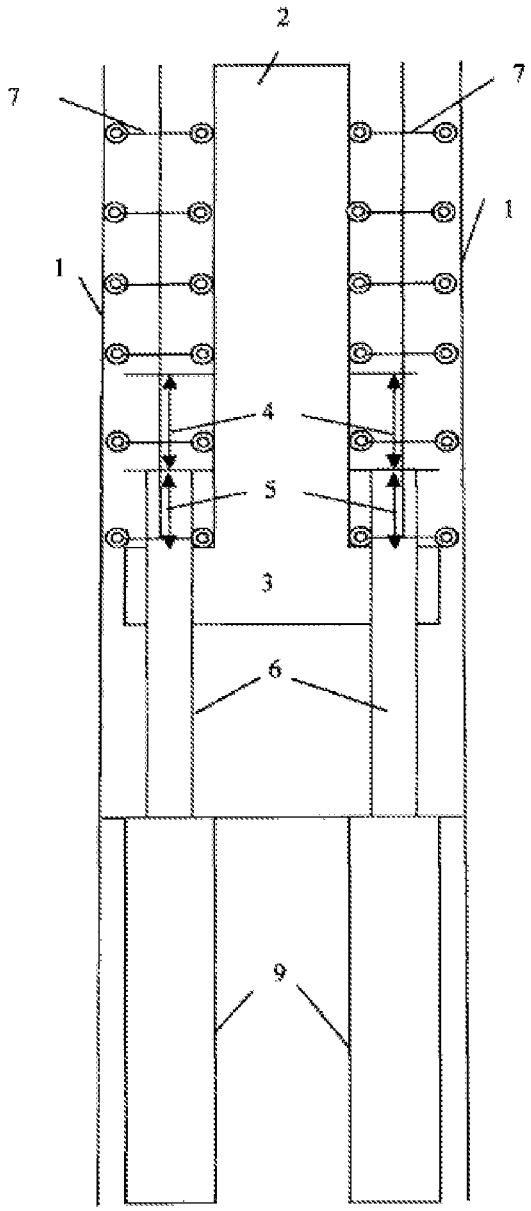
FIG. 1 is a schematic elevation view of a construction assembly comprising retaining structures, jacks, pillars and supports with rollers.
Figure 2:
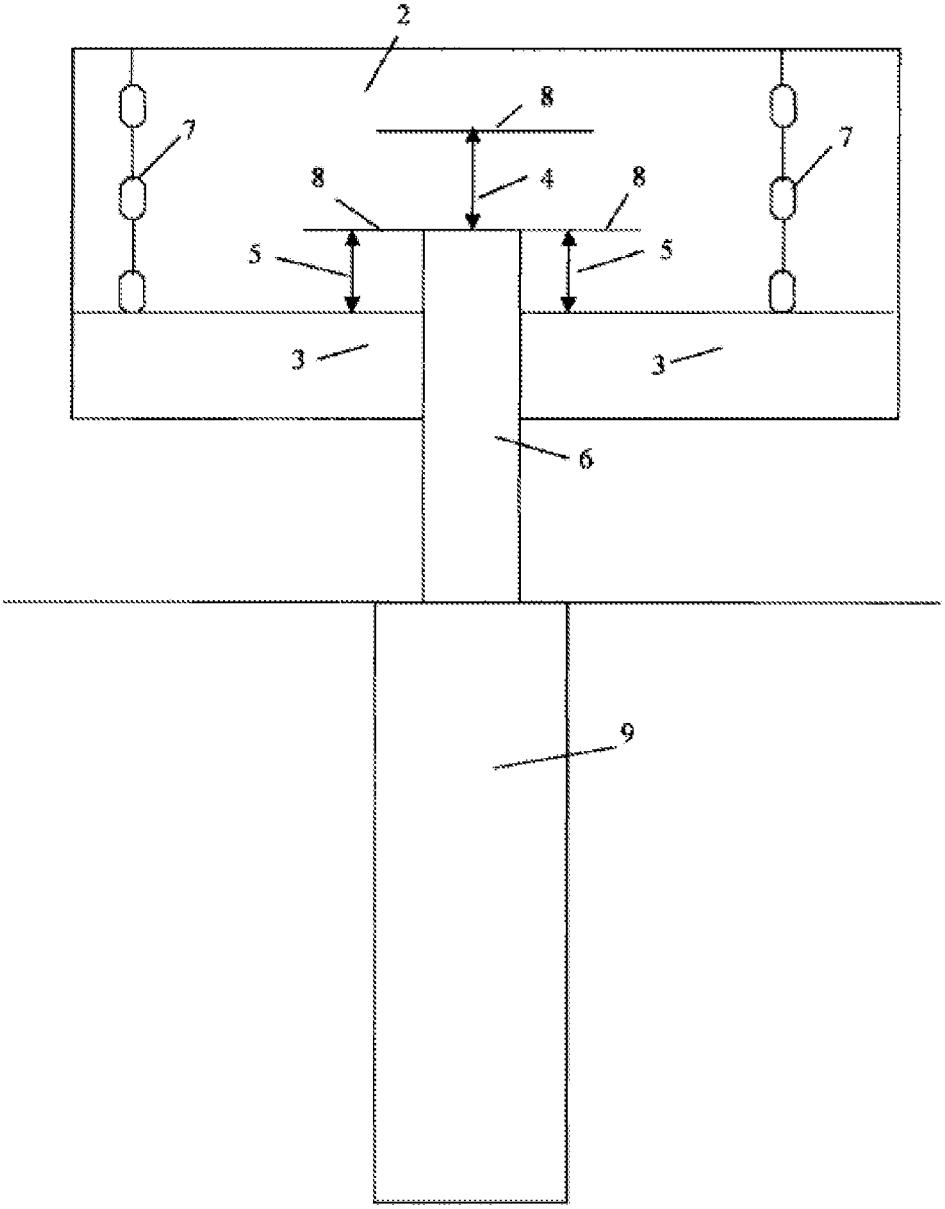
FIG. 2 is a schematic side view of a construction assembly comprising retaining structures, jacks, pillars and supports with rollers.
Figure 3:
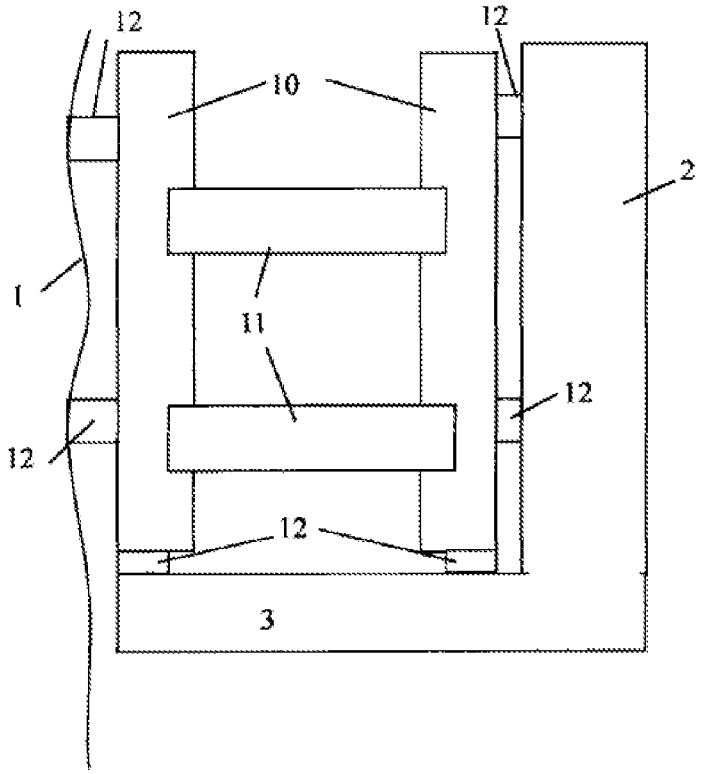
FIG. 3 is a schematic side view of support replacement.
Figure 4:
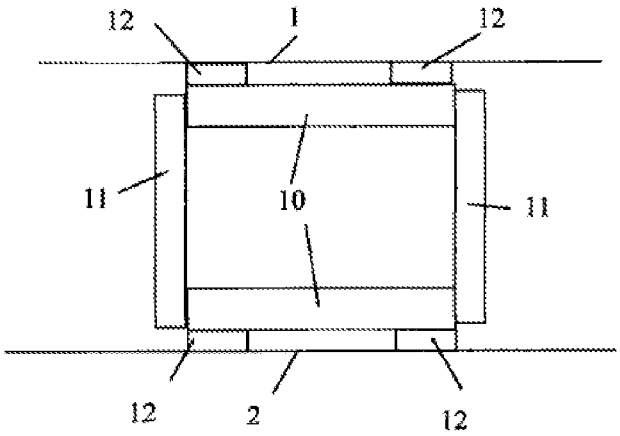
FIG. 4 is a top view of support replacement.

The following components are included in the drawings: retaining structures 1, a wall 2, a wall bottom plate 3, jacks (press) 4, jacks (support) 5, pillars 6, elastic support rods 7 with rollers, cantilever counterforce pieces 8, a reinforced rock-soil mass 9 under the pillars, sheet piles 10, steel sheets 11 and gaskets 12.

DETAILED DESCRIPTION

The present invention is described in detail below with reference to the drawings and specific embodiments.

1. Preparation before trench excavation: The physical and mechanical characteristics of the rock-soil mass in a trench corresponding to a wall are investigated so as to provide a basis for the selection of an excavator at the bottom of the wall. When the excavated soil layer is mainly a cohesive soil layer, a track beam is preferably embedded at the bottom of the wall. The excavator at the bottom of the wall preferably walks on the track beam in a suspension mode, and the mechanical weight is transmitted from the wall to adjacent pillars 6. Lightweight equipment is selected. When the excavated soil layer is mainly sandy soil or rock, a crawler excavator may be employed, and the weight of the excavator is borne by the rock-soil mass not excavated. After the excavator is selected, the height of the required working space is determined. Besides, the load to be borne by the pillars 6 at the bottom of the wall can be determined according to the weight of a wall 2, the weight of the excavator and the weight of elastic support rods 7. Deduction and verification are performed according to the investigated physical and mechanical parameters of the rock and soil so as to decide whether the rock-soil mass under the pillars 6 can meet the requirements for the bearing capacity or not. Otherwise, a rock-soil mass 9 under the pillars is to be locally reinforced, and the possible measures may include using single-shaft cement-soil mixing piles or plain concrete piles, so that the single piles bearing capacity can meet the requirements under various working conditions. In the travel determination of the jacks, excavation errors are to be taken into consideration. The physical and mechanical characteristics of the rock-soil mass on two sides of the trench corresponding to the wall are investigated so as to provide parameters for the design of the retaining structures and the elastic support rods 7 with rollers between the retaining structures and the wall. The retaining structures 1 may be selected from conventional cement-soil mixing pile walls, steel sheet piles, steel pipe piles, shape steel piles, diaphragm walls (plain concrete) and various plain concrete piles that are formed by hole drilling and digging. When the retaining structures are used as slope retaining walls, pluggable steel piles are preferred so as to prevent the water pressure from intensifying if water draining behind the wall is required, and holes can be helpfully drilled if the steel piles are hard to sink. In the working space at the bottom of the wall and under the conditions of the supports 7 with rollers and support replacement, the bearing capacity of the retaining structures 1 needs to meet the requirements. In this construction method, the excavation at the bottom of the wall can be implemented in the presence of water, so that the retaining structures are not required to block water. The retaining structures 1 (including soil outlets) are formed on the two sides of the trench corresponding to the wall. The soil outlets not only are used for transporting out the rock-soil mass at the bottom of the wall but also provide a passage so that the excavator at the bottom of the wall can be repaired and recovered. When a tower crane is required for construction, the tower crane can be further mounted at the position of the soil outlet. Therefore, the position and size of the soil outlet are to be planned in advance. As no inner support is arranged at the soil outlet, the soil outlet is preferably configured into a round shape, and its retaining structure is also preferably reinforced appropriately. The trench is excavated and a guide wall is constructed along the direction of the wall. The guide wall is used to match with the retaining structures so as to ensure the positioning of the sunk wall, and also to provide a base for mounting a measuring rod. A wall bottom plate 3 and a wall of a certain height are fabricated on the ground by in situ casting or prefabrication. Holes are to be formed in the bottom plate so as to enable the pillars to pass through. If the wall is to be connected to other components after sinking in place, embedded components need to be reserved on the corresponding positions of the wall. The bottom plate 3 can be used for transmitting the weight of the elastic support rods 7 with rollers and also as the counter force of jacks 5, as well as for improving the foundation stress after the wall foundation is backfilled. Cantilever counterforce pieces 8 are symmetrically mounted or in situ cast at intervals near the bottom of the wall, and are also symmetrically mounted or in situ cast at tops of the pillars. The weight of the wall is transmitted from the counterforce pieces 8 through the jacks 4 to the pillars 6 and then to the rock-soil mass not excavated in the trench or a reinforced rock-soil mass 9 under the pillars, and thus, under the enclosure of the retaining structures 1 on the two sides and the pillars 6, an operation space of a height that meets the requirement for the operation of the excavator at the bottom of the wall is formed at the bottom of the wall.

2. Controlled wall sinking construction: In the operation space, the rock-soil mass in the trench is excavated in layers along the direction of the wall by remotely controlling an underwater excavator, conveyed to the soil outlet and discharged by a grab bucket. The excavator can be powered by electricity and provided with underwater monitoring devices so as to be adapted for underwater operation. The underwater remote-controlled excavation is low in efficiency and slow in speed as it is more demanding than the open-air operation. Besides, the devices generally need to be lifted from the soil outlet to the ground for repair when in failure and thus in need of repair, leading to a long period of repair. Furthermore, the fabrication of the wall 2 is complicated and time consuming. For this reason, the overall arrangement of the fabrication of the wall 2 and the progress of the excavation at the bottom of the wall can be employed so as to reduce the adverse effect of the slow excavation speed on the progress. In order to prevent the retaining structures on the two sides from being damaged, the single-layer excavation thickness is to be controlled. Elevation transmission can be achieved using a measuring rod (with controllable verticality) arranged from the ground deep to an excavation surface at the bottom of the wall so as to control the excavation elevation. When the excavation proceeds to a certain pillar 6, this pillar can be temporarily lifted by jacks 5, and then put down after the rock and soil under this pillar is excavated and the surface is flattened. When the pillar is lifted, the weight of the wall borne by the pillar can be transmitted through the wall to adjacent pillars. If the excavated rock and soil has a high water content, the electroosmosis method or vacuum preloading in combination with plastic drainage plates may be employed to reduce the water content before transport. As the rock-soil mass is excavated in layers, the pillars 6 are pressed by the jacks 4 until they are stably settled. The jacks 4 and 5 are networked and coordinated by an electronic computer to control the wall 2 to uniformly sink. Between the wall and the retaining structures on the two sides of the trench is sandwiched the elastic supports 7 with rollers, which transmits and balances the rock-soil pressure and also ensures that the friction is controllable during the sinking of the wall 2. The retaining structures 1 can be regarded as elastic beam plates, and each elastic support rod 7 can be regarded as an elastic support point. The rigidity of the elastic support rods 7 needs to meet the requirements for peripheral deformation control. The elasticity of the support rods 7 can be realized by a spring or a jack. As the wall 2 sinks, the number of the elastic support rods 7 is continuously increased. The elastic support rods 7 on the same section can be connected by rod pieces to form a rod piece set, and the weight of the rod piece set is transmitted through the wall bottom plate 3 to the pillars 6. The rollers are in direct contact with the retaining structures 1 and the wall 2. If the surface of the wall 2 is waterproofed, tire rollers are to be employed so as to prevent the waterproofness from being damaged. The elastic support rods 7, if comprising jacks, can be used to adjust and control the plane position of the wall 2. The wall 2 needs to be built to a certain height on the ground when controlled by the jacks 4 to sink to a certain depth. If necessary, the wall 2 can be waterproofed on the ground. The fabrication of the wall 2 and the waterproofing are both implemented on the ground, and the efficiency and quality can be both improved compared to those of the underground construction due to the sufficient operation space. If a steel support is to be sunk, steel support rods can also be connected to form a wall-shaped structure, and sink in sections after being connected to a basement outer wall. Before large-area excavation of the soil mass in the foundation pit, the basement outer wall, together with the internal steel supports, is positioned in place to form a space support system, which can prevent the safety problems caused by over excavation and mistimed support. The steel support wall can be flexibly positioned, and the support system is highly adaptable to the construction scheme and geology.

3. Wall foundation construction: After the wall 2 sinks in place, the elevation of the wall 2 is adjusted using the jacks 4 and 5 at the bottom of the wall, and the plane position of the wall 2 is adjusted using the supports 7 (comprising jacks) sandwiched between the wall and the retaining structures. The waste soil is cleaned, and the excavator is recovered (this can be implemented using a manned submersible with manipulators or an underwater robot in the presence of water). The wall is backfilled at the bottom so as to complete the foundation construction. The jacks 4 and 5 and the measurement and control devices at the bottom of the wall are dismantled and recovered (this can be implemented using an underwater robot with manipulators in the presence of water).

4. Support replacement (when the supports with rollers are to be recovered): The shapes and curves of the trench wall and the wall at each support replacement position are measured, and gaskets 12 are attached to prefabricated support sheet piles 10 according to the curves. After being separated into the trench, two prefabricated support sheet piles 10 are separately attached to the trench wall and the wall and then connected by steel sheets 11 to form a lattice support (this can be implemented by welding in the absence of water; or implemented using bolts in the presence of water, and the positions of the bolt holes on the steel sheets 11 are obtained according to the actually measured distances of the corresponding points of the trench wall and the wall, as well as the thickness of the gaskets 12, the compression modulus and the positions of the pre-embedded bolt holes in the sheet piles 10). After all supports are replaced, the elastic support rods 7 with rollers are lifted out.

5. Foundation trench backfilling: For those cases in which waterproof curtains are required, a continuous space body formed by the foundation trench can be considered to be backfilled with a waterproof material, forming the waterproof curtain with the backfill of the foundation trench. For those cases in which backfilling with sand and stone is to be implemented manually, the width of the backfilling side needs to be reserved enough in the design stage, that is, the foundation trenches on the two sides of the wall can have different widths.

What is claimed is:

1. A wall-sinking construction method, comprising:

(a) forming retaining structures on two sides of a trench corresponding to a wall to be sink, the wall has a bottom plate;

(b) supporting the wall by first jacks to suspend the wall;

(c) remotely controlling an underwater excavator to excavate rock and soil in the trench layer by layer at a bottom of the wall;

(d) sandwiching elastic support rods with rollers between the wall and the retaining structures on the two sides of the trench; the elastic support rods with rollers are symmetrically arranged on two sides of the wall from top surface of the wall bottom plate upward in an excavated trench;

(e) controlling the wall to sink using the first jacks;

(f) constructing a wall foundation;

(g) implementing support replacement when the elastic support rods with rollers are to be recovered; and (h) backfilling a foundation trench.

2. The wall-sinking construction method according to claim 1, wherein at the bottom of the wall is provided a track beam; steel support rods are connected to form a wall-shaped structure and sunk in sections after being connected to a basement outer wall and sunk in place before large-area foundation pit excavation; on a side of the trench is provided a soil outlet and a corresponding retaining structure; the retaining structure is one selected from a plain concrete pile, a plain concrete diaphragm wall, a steel sheet pile and a cement-soil mixing pile; each the elastic support rod with rollers comprises either a spring or a jack; fabrication of the wall and progress of the excavation at the bottom of the wall are overall coordinated; elevation transmission is achieved using a measuring rod arranged from ground deep to an excavation surface at the bottom of the wall so as to control the single-layer excavation thickness; a continuous space formed by a foundation trench is backfilled with a waterproof material, forming a waterproof curtain with the backfill of the foundation trench.

3. The wall-sinking construction method according to claim 1, wherein the step (b) comprises: excavating a trench to form a guide wall, and fabricating a wall bottom plate and the wall of a certain height on the ground; mounting or in situ casting cantilever counterforce pieces on the wall near the bottom of the wall; mounting pillars, and mounting or in situ casting cantilever counterforce pieces at tops of the pillars; and mounting the first jacks and the second jacks, and supporting the wall at the bottom of the excavated trench by the first jacks on the pillars so as to suspend the wall and thus to form an operation space for excavation at the bottom of the wall.

4. The wall-sinking construction method according to claim 3, wherein the rock-soil mass under the pillars at the bottom of the wall is locally reinforced using either a single-shaft cement-soil mixing pile or a plain concrete pile; the pillars are symmetrically arranged on two sides of the bottom of the wall; the pillars are positioned at the bottom of the excavated trench; the weight of the wall is transmitted from the counterforce pieces on the wall through the first jacks to the pillars and then to the rock-soil mass not excavated in the trench or a reinforced rock-soil mass under the pillars.

5. The wall-sinking construction method according to claim 1, wherein in the step (c), when the excavation proceeds to a certain pillar, the pillar is temporarily lifted by second jacks, and then put down after a layer of the rock and soil under the pillar is excavated.

6. The wall-sinking construction method according to claim 5, wherein when the pillar is lifted, the weight of the wall borne by the pile is transmitted through the wall to adjacent pillars.

7. The wall-sinking construction method according to claim 1, wherein in the step (d), rollers are provided at both ends of each the elastic support rod, with one end of the elastic support rod in contact with the retaining structure and the other end of the elastic support rod in contact with the wall; the elastic support rods with rollers transmit and balance the rock-soil pressure and also control the friction of the wall during sinking; the elastic support rods on the same section are connected by connecting rods to form a rod piece set, and the weight of the rod piece set is transmitted through the wall bottom plate to pillars.

8. The wall-sinking construction method according to claim 1, wherein the step (e) comprises: pressing pillars by the first jacks until the pillars are stably settled when the rock-soil mass is excavated in layers; coordinating all jacks to control the wall to uniformly sink in sections; and building the wall to a certain height on the ground when the wall is controlled by the jacks to sink to a certain depth.

9. The wall-sinking construction method according to claim 1, wherein the step (f) comprises: adjusting the elevation of the wall using the first jacks and the second jacks after the wall sinks in place, and adjusting the plane position of the wall using the elastic support rods sandwiched between the wall and the retaining structures; cleaning waste soil and recovering the excavator; backfilling the wall at the bottom to complete the foundation construction; and dismantling and recovering the first jacks, the second jacks and measurement and control devices at the bottom of the wall.

10. The wall-sinking construction method according to claim 1, wherein the step (g) comprises: measuring the shapes and curves of the trench wall and the wall at each support replacement position; attaching gaskets to prefabricated support sheet piles according to the curves; attaching the two prefabricated support sheet piles separately to the trench wall and the wall after the sheet piles are separated into the trench, and then connecting the two sheet piles by steel sheets to form a lattice support; and lifting out the elastic support rods with rollers after all supports are replaced.

* * * * *